US005831646A

United States Patent [19]

Kuronuma et al.

[11] Patent Number: 5,831,646

[45] Date of Patent: Nov. 3, 1998

[54] CONTROLLING A DISCHARGE RECOVERY OPERATION ACCORDING TO A CONDITION RELATING TO AN INK CARTRIDGE

[75] Inventors: Akira Kuronuma; Takayuki Murata, both of Kawasaki; Hiroshi Fukui, Yokosuka; Akira Nagatomo; Shinichi Omo, both of Yokohama, all of Japan

[73] Assignee: Canon Kabushiki Kaisha, Tokyo, Japan

[21] Appl. No.: 811,453

[22] Filed: Mar. 3, 1997

Related U.S. Application Data

[63] Continuation of Ser. No. 233,467, Apr. 26, 1994, abandoned.

[30] Foreign Application Priority Data

Apr. 26, 1993 [JP] Japan ..... 5-122004
Apr. 26, 1994 [JP] Japan ..... 6-110491

[51] Int. Cl.[6] ..... B41J 2/165

[52] U.S. Cl. ..... 347/30; 347/23

[58] Field of Search ..... 347/14, 19, 23, 347/49, 29, 30, 32, 33, 36, 38, 104

[56] References Cited

U.S. PATENT DOCUMENTS 5,049,898 9/1991 Arthur et al. ..... 347/49
5,121,131 6/1992 Bouldin et al. ..... 347/2
5,132,710 7/1992 Ejiri et al. ..... 347/3
5,138,344 8/1992 Ujita et al. ..... 347/19
5,495,271 2/1996 Koitabashi et al. ..... 347/23

FOREIGN PATENT DOCUMENTS 0556 011 8/1993 European Pat. Off. ..... 347/23
3-73354 3/1991 Japan .
3-193461 8/1991 Japan ..... 347/24
4-344258 11/1992 Japan ..... 347/36
5-31909 2/1993 Japan ..... 347/23

*Primary Examiner*—N. Le
*Assistant Examiner*—L. Anderson
*Attorney, Agent, or Firm*—Fitzpatrick, Cella, Harper & Scinto

[57] ABSTRACT

An ink jet printing apparatus has a discharge recovery system that controls the amount of ink suction in a discharge recovery operation on the basis of a property of the ink in a cartridge mounted on the apparatus. The discharge recovery operation can also be controlled when the power to the apparatus is turned on if a cartridge has been replaced or mounted while the power is off.

11 Claims, 17 Drawing Sheets

CONTROLLING A DISCHARGE RECOVERY OPERATION ACCORDING TO A CONDITION RELATING TO AN INK CARTRIDGE

This application is a continuation of application Ser. No. 08/233,467 filed Apr. 26, 1994, abandoned.

BACKGROUND OF THE INVENTION

1. Field of the Invention

The present invention relates to discharge recovery in an ink jet printing apparatus, and more particularly, to an apparatus and method in which an ink discharge recovery operation is performed in accordance with an ink cartridge condition such as a property of the ink therein or a condition relating to the mounting of the cartridge on the apparatus.

2. Related Background Art

A printing apparatus that functions as a printer, a copying machine, a facsimile machine or the like, or a printing apparatus used as an output terminal of a computer, a word processor, a workstation or the like, prints an image including characters and symbols on a printing medium such as paper, plastic film or the like. Such printing apparatus can be classified in accordance with the printing method it uses, such as an ink jet method, wire dot method, thermosensitive method, thermal transfer method and laser beam method, etc.

A popular type of ink jet printing apparatus, sometimes referred to as a serial-type printing apparatus, adopts a serial scanning method of scanning a printing head in a main-scan direction transverse to a sub-scan printing medium conveying direction. The printing head is mounted on a carriage movable in the main-scan direction along the printing medium, and after a main scan the printing medium is fed in the sub-scan direction by a predetermined amount corresponding to the length of an array of liquid discharge ports on the printing head. The next line of the image can then be printed on the printing medium by the scanning printing head. The head scanning and printing medium conveying are thus repeated until the entire printing medium has been printed.

Ink jet printing is a low-noise method of printing because it involves a non-impact technique of discharging ink onto a printing medium, and miniaturization of ink jet printing heads can be readily accomplished. Ink jet printing apparatus can perform high-resolution printing at a high speed, and can print on paper that has not been specially treated, with a resulting low running cost. In addition, it is easy to conduct multicolored printing using multicolor inks.

As printing means of an ink jet printing apparatus, an ink jet head that has energy generating means such as an electrothermal converter for generating energy, which acts on ink to cause film boiling that discharges the ink from a discharge portion, is preferably used. Such a printing head generally has electrodes, liquid passage walls and a top plate provided on a substrate through semiconductor manufacturing processes, which incorporate various techniques including etching, vapor deposition, sputtering or the like. Since the ink discharge ports used for forming the flying liquid droplets required for printing can be readily arranged with high density, such an ink jet printing head has the advantages of being compact and easily fabricated and capable of high resolution printing.

In the process of manufacturing the recording head, the advantages of IC (integrated circuit) technology or miniaturization technology, which have been recently significantly improved form the viewpoint of reliability and progress in the field of semiconductor manufacturing, can be adopted as much as possible. It is also possible to provide a recording head with a two-dimensional array of discharge ports.

FIG. 5 is schematic vertical cross-sectional view showing an ink jet discharging portion of a conventional ink jet printing head 1. As illustrated in FIG. 5, a plurality of discharge openings 4 are provided at a certain pitch in a substantially vertical direction on a surface 2 of the printing head 1, which is positioned opposed to a printing medium 3, such as printing paper, at a certain gap (for example about 0.5 to 2.0 mm) from the surface. A heat generating portion of an electrothermal converting body 5 for generating thermal energy to be utilized to discharge ink is provided on a wall of each ink path 6 which communicates between a common ink chamber 10 and each discharge opening 4. The ink jet printing head 1 is mounted on a carriage (not shown in FIG. 5) so that the discharge openings 4 are disposed in line transverse to the direction of the movement of the carriage (the main-scanning direction).

Ink is discharged as shown at 8 from a selected discharge opening 4 of the printing head 1 by driving the corresponding electrothermal converting body in response to a discharge signal to generate a bubble 7 by film boiling in the ink in the corresponding ink path 6. The discharged ink forms a droplet attached on a printing medium 3 and printing by forming a dot pattern is thus performed. When the driving of the electrothermal converter 5 is stopped, the ink passage 6 in the ink jet head 1 is cooled and the bubble 7 disappears.

The ink jet head 1 is provided with head drivers 9 for turning on or off an electrode to the electrothermal converter 5, and a circuit board for the head drivers 9 is provided on the carriage.

FIG. 6 shows a schematic perspective view of a conventional ink jet printing apparatus that uses such an ink jet head.

In FIG. 6, a printing head section 52 and an ink tank 53 are incorporated in a head cartridge 51, and the head cartridge 51 is detachably mounted on a carriage 54. The carriage 54 goes and returns in the X and Y directions (the main-scanning direction) along a carriage drive axis 55 and a guide axis 56 by the rotation of the carriage drive axis 55. A spiral groove 57 on the carriage drive axis 55 accepts a pin (not shown) on the carriage 54 to drive the carriage 54 parallel to the carriage drive axis 55 by the rotation thereof.

The head cartridge 51 is fixed to a predetermined position on the carriage 54 by positioning means. The head cartridge 51 is electrically connected through a contact point to a flexible cable provided for connecting the head cartridge 51 and a control circuit in the printing apparatus.

In FIG. 6, a transfer roller 59 for conveying the printing medium 58 in the sub-scan direction is rotatably provided parallel to the carriage drive axis 55 and facing the carriage 54 in its moving area. The transfer roller 59 also functions as a platen. The transfer roller 59 is driven by a transfer motor 60. The printing medium 58 is urged to the transfer roller 59 along the direction of movement of the carriage 54 by a printing medium regulating means 61.

The printing head 52 is an ink jet printing head operating on the principles discussed above in connection with FIG. 5 and having an electrothermal converter for generating heat energy to discharge ink from the discharge port thereof. FIG. 7 shows a schematic perspective view for explaining the structure of the ink discharge portion of the printing head 52.

In FIG. 7, an ink discharge port surface 81 faces the printing medium at a predetermined interval (for example, 0.5 mm to 2.0 mm), and plural ink discharge ports 82 are disposed at predetermined intervals on the surface 81.

Electrothermal converters 85, such as heat generating resistors for generating thermal energy to be used for discharging ink, are provided along an inner wall of each ink path 84 which communicates a common ink chamber 83 and each discharge port 82. In this embodiment, the head cartridge 51 is mounted on the carriage 54 such that the discharge ports 82 are arranged side-by-side transverse to the moving direction of the carriage 54 (the main-scanning direction).

The printing head is thus constructed so that ink is discharged from the discharge port 82 by pressure which is generated when the corresponding electrothermal converter 85 is actuated in accordance with an image signal or discharge signal and film boiling is caused in the ink in the ink path 84.

In FIG. 6, a drive motor 62 is provided in the body of the ink jet printing apparatus. The carriage drive axis 55 is rotated through drive force transfer gears 63 and 64. The moving direction (arrow X or Y) of the carriage 54 is determined by forward or reverse rotation of the carriage drive axis 55 driven by rotation of the drive motor 62.

A home position of the carriage 54 is determined in a predetermined position (to the left in FIG. 6) outside of the printing area and within the moving area of the carriage 54. A photocoupler 65 is provided near the home position. This photocoupler 65 detects that the carriage 54 in the home position by detecting a lever 66 on the carriage 54. This photocoupler 65 is used as a detecting means for detecting the position of the carriage 54 for controlling various operations of the printing apparatus, such as reversing the carriage 54 by changing the rotating direction of the drive motor 62 when the printing head 52 comes to the home position, or an ink discharge recovery operation for recovering the discharge condition of the discharge port 82 of the printing head 52.

At the home position, there is a cap 68 for covering the discharge port surface 81 of the printing head 52 of the head cartridge 51. The cap 68 is held by a cap holder 69 such that it is movable toward the head for covering the discharge port surface 81 and away from the head for exposing the discharge port surface 81.

A blade (cleaning member) 70, for wiping and clearing the discharge port surface 81, is provided between the cap 68 and the printing area. This blade 70 is held by a blade holder 72, supported by a plate 71 attached to the apparatus body, such that the blade 70 is movable between a forward position in which the blade 70 can wipe the discharge port surface 81 and a retracted position in which the blade 70 does not contact the discharge port surface 81. As other cleaning means for cleaning the discharge port surface 81, besides the above-described blade 70, there can be any member capable of removing foreign material from the discharge port surface 81.

Operations such as capping of the discharge port surface 81 and cleaning the discharge port surface 81 are carried out by moving or stopping the carriage 54 at a predetermined timing within the vicinity of the home position.

FIGS. 8(A)–8(D) show various views of the head cartridge 51. FIG. 8(A) shows a plan view; FIG. 8(B) is a side view; FIG. 8(C) is a bottom view; and FIG. 8(D) is a back view.

A control unit including a CPU, ROM and RAM etc. provided in the printing apparatus receives a command signal and a data signal (printing information) from a controller of a host apparatus to control the printing operation of the ink jet printing apparatus.

If the apparatus conducts an ink discharge operation continuously for a long time, small bubbles 11 as shown in FIG. 5 can sometimes remain in the ink passage 6. When a bubble 7 is generated in the ink passage 6 by driving the electrothermal converter 5 in order to conduct printing, these small bubbles 11 can obstruct the proper transmission to the ink of pressure generated by the bubble 7, so that the desired ink discharge cannot be performed, which results in deterioration of print quality. In addition, the small bubbles 11 can gradually grow into a single large bubble, and as a result, the temperature of the electrothermal converter 5 may become unduly elevated and in the worst case may break.

To avoid such damage when ink discharge has been conducted for a long time, it is necessary to suck the bubbles 11 from the ink passages by applying suction to the discharge openings and sucking the ink containing the bubbles from the head. However, in a conventional recovery operation, the same sucking operations have been conducted irrespective of the properties of the ink (such as its color, density or the like). This can result in removal of an insufficient amount of ink for an ink with a high viscosity or too much ink for an ink with low viscosity. In one case, recovery is not accomplished and in the other ink is wasted.

Moreover, in an ink jet printing apparatus using a head cartridge such as that shown in FIGS. 6 and 8, the head cartridge may have been in a state of non-use for a long time. Accordingly, before starting a printing operation, an ink discharge recovery operation is conducted for clearing any clogging of ink in the discharge port by sucking ink from inside the discharge port to recover the ink discharge condition to its normal condition. In that connection, a conventional ink jet printing apparatus may utilize a timer circuit that starts counting from the time a recovery operation is finished. Then, if the timer has counted a predetermined time period by the time the printing apparatus is turned back on, an ink discharge recovery operation is automatically conducted.

There is a problem in conventional ink jet printing apparatus in which an ink discharge recovery operation is conducted when the apparatus is turned on and a predetermined time period has passed since the last printing operation or recovery operation. In such printing apparatus, the timer generally works irrespective of operation of a power supply switch or whether the head cartridge has been changed. Therefore, if the time while the printing apparatus is not used is short, a recovery operation will not be conducted when the power supply switch is turned back on, even if a new head cartridge that has been on a shelf for a long time was mounted in the apparatus in the interim.

For that reason, the recovery operation will not be conducted at the proper time for the new head cartridge and, as a result, poor printing will sometimes occur because of clogging in an ink discharge opening.

SUMMARY OF THE INVENTION

The present invention is designed to overcome the above problems in conventional structure. It is accordingly an object of the present invention to provide an ink jet printer capable of continuous fine printing on a printing medium without poor ink discharge.

In accordance with one feature of the present invention, an ink jet printing apparatus for printing an image using printing means for discharging ink onto a printing medium comprises discriminating means for discriminating a property of an ink to be used by the printing means, discharge recovery means for recovering and maintaining a normal ink discharge condition of the printing means, and control means for controlling operation of the ink discharge recovery means in accordance with the property of the ink discriminated by the discriminating means.

In accordance with another feature of the present invention, an ink discharge recovery method for an ink jet printing apparatus that includes printing means for discharging ink onto a printing medium comprises the steps of discriminating a property of the ink to be discharged by the printing means, performing a discharge recovery operation for maintaining a normal ink discharge condition of the printing means, and controlling the ink discharge recovery operation in accordance with the property of the ink discriminated in the discriminating step.

In accordance with still another feature of the present invention, an ink jet printing apparatus for printing an image using printing means mountable on the apparatus for discharging ink in an ink container onto a printing medium, the ink container being detachable from the apparatus, comprises detecting means for detecting detachment of the ink container from the apparatus while power is not being supplied thereto, discharge recovery means for performing a recovery operation to maintain a normal ink discharge condition of the printing means, and control means for controlling the ink discharge recovery means to perform the recovery operation when power is supplied to the apparatus if the detecting means detects that the ink container was detached from the apparatus while power was not being supplied thereto.

In accordance with a further feature of the present invention, an ink discharge recovery method for an ink jet printing apparatus using printing means mountable on the apparatus for discharging ink in an ink container onto a printing medium, the ink container being detachable from said apparatus, comprises the steps of detecting detachment of the ink container from the apparatus while power is not being supplied thereto, and performing a recovery operation to maintain a normal ink discharge condition of the printing means when power is supplied to said apparatus if it is detected that the ink container was detached from the apparatus while power was not being supplied thereto.

In accordance with a yet further feature of the present invention, an ink jet printing apparatus for printing an image using printing means mountable on the apparatus for discharging ink in an ink container onto a printing medium, the ink container being detachable from the apparatus, comprises detecting means for detecting mounting of the ink container on the apparatus while power is not being supplied thereto, discharge recovery means for performing a recovery operation to maintain a normal ink discharge condition of the printing means, and control means for controlling the ink discharge recovery means to perform the recovery operation when power is supplied to the apparatus if the detecting means detects that the ink container was mounted to the apparatus while power was not being supplied thereto.

In accordance with yet another feature of the present invention, an ink discharge recovery method for an ink jet printing apparatus using printing means mountable on the apparatus for discharging ink in an ink container onto a printing medium, the ink container being detachable from the apparatus, comprises the steps of detecting mounting of the ink container on the apparatus while power is not being supplied thereto, and performing a recovery operation to maintain a normal ink discharge condition of the printing means when power is supplied to the apparatus if it is detected that the ink container was mounted on the apparatus while power was not being supplied thereto.

BRIEF DESCRIPTION OF THE DRAWINGS

FIG. 8(A) is a plan view; FIG. 8(B) is a side view; FIG. 8(C) is a bottom view; and FIG. 8(D) is a back view.

DETAILED DESCRIPTION OF THE PREFERRED EMBODIMENTS

Embodiments of ink jet printing apparatus according to the present invention will be described in detail with reference to the accompanying drawings.

Figure 1:
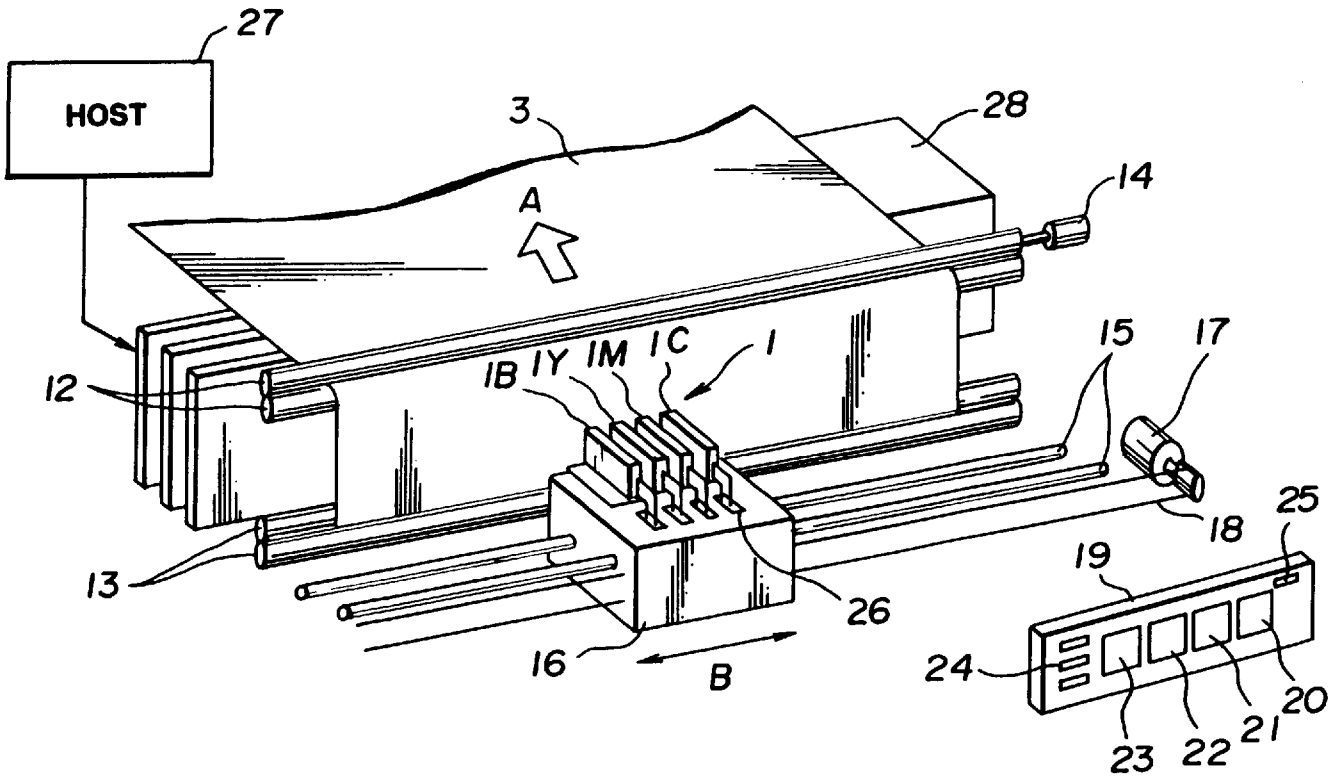
FIG. 1 is a schematic perspective view showing a main portion of a color ink jet printing apparatus according to one aspect of the present invention.
Figure 5:
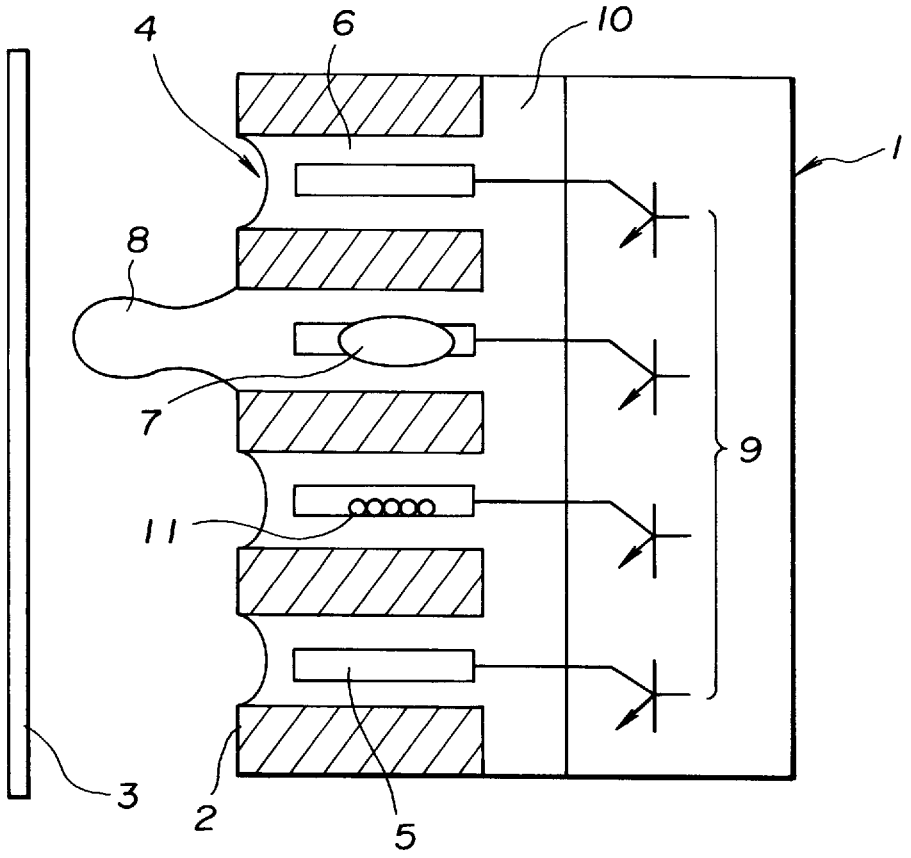
FIG.5 (PRIOR ART)
FIG. 5 is a schematic vertical cross-sectional view showing an ink jet discharging portion of a conventional printing head.

FIG. 1 is a schematic perspective view showing a main portion of a color ink jet printing apparatus which has four ink jet printing heads having electrothermal converters as shown in FIG. 5 as discharge energy generating means.

In FIG. 1, a printing medium 3 such as paper, a plastic sheet or a cloth sheet is supported by conveying rollers 12 and conveying rollers 13 provided at the upper and lower side of a printing area and is conveyed by the conveying rollers 12 which is driven by a convening motor 14 in a sub-scanning direction (arrow A) transverse to the main scanning movement of the carriage 16 (the direction of movement of the printing head 1) through a printing area.

Guide shafts 15 are provided parallel to and in front of the conveying rollers 12 and conveying rollers 13. The movement of the carriage 16 is carried out in the direction of arrow B through a wire 18 by driving a carriage motor 17 in either direction.

A printing head 1C for discharging cyan ink (C), a printing head 1M for discharging magenta ink (M), a printing head 1Y for discharging yellow ink (Y), and a printing head 1B for discharging black ink (B) are carried on the carriage 16 along the direction of the scanning movement of the carriage 16. All of these printing heads discharge ink using thermal energy. In the following description, reference to a printing head (printing means) 1 can denote each of the printing heads 1C, 1M, 1Y and 1B or all of these printing heads, depending on the context. Each printing head operates on the principles discussed above in connection with FIG. 5, and has ink discharge ports in the front portion of the head with a surface facing the printing medium and spaced therefrom by a predetermined amount (for example, 0.8 mm). A plural number (for example, 48 or 64) of the ink discharge ports are arranged in a line transverse to the direction of movement of the carriage 16.

An operation panel 19 is provided on a case (not shown) of the ink jet printing apparatus. On the operation panel 19, there is a key setting portion containing an on-line/off-line switching key 20, a line feed key 21, a form feed key 22, and a printing mode switching key 23, and an indication portion containing plural warnings lamps 24 and a power source lamp 25.

A circuit board 26 (see FIG. 1) of a driving circuit to drive the head drivers is carried on the carriage 16. A control unit in the ink jet printing apparatus, which contains a control circuit (CPU), ROM, RAM and so on, receives a command signal and data signal (printing information). The control unit controls and drives motors such as the motor 14 and the motor 17 or the like, and electrifies the head's electrothermal converters through the driving circuit 26 and the head driver on the basis of the command signal and the data signal, using a power source circuit 28.

Figure 2:
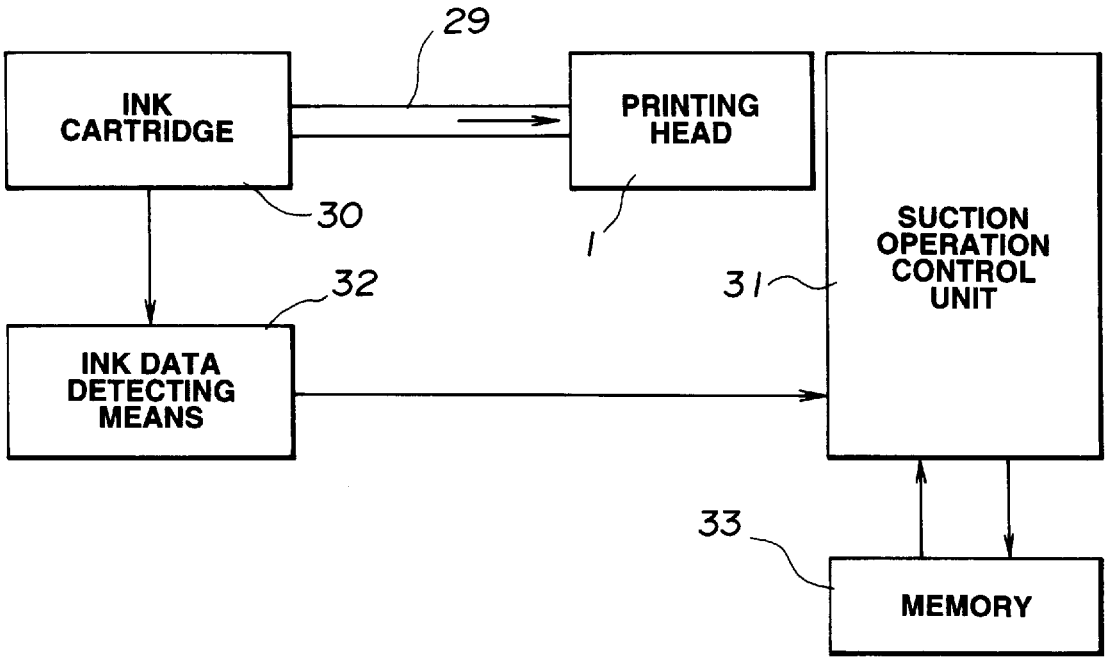
FIG. 2 is a schematic block diagram for explaining the main constitution of an ink jet printing apparatus according to the present invention.

FIG. 2 shows a schematic block diagram of a main part of the printing apparatus.

In FIG. 2, a printing head 1 prints the information on the printing medium by discharging ink thereon. An ink supply path 29 supplies ink to the printing head 1 from a detachable ink cartridge 30 with a built-in ink tank. A suction operation control unit 31 controls ink suction from the discharge ports of the printing head 1. The ink jet printing apparatus shown in FIG. 1 uses separate ink cartridges for cyan ink (for printing head 1C), magenta ink (corresponding to printing head 1M), yellow ink (corresponding to printing head 1Y), and black ink (corresponding to printing head 1B).

An ink data detecting means (ink property discriminating means) 32 for each cartridge provides data relating to the ink contained in the ink cartridge and sends it to the suction operation control unit 31. A memory 33 stores the information corresponding to the data sent from the ink data detecting means 32 for use by the suction operation control unit 31.

Figure 3:
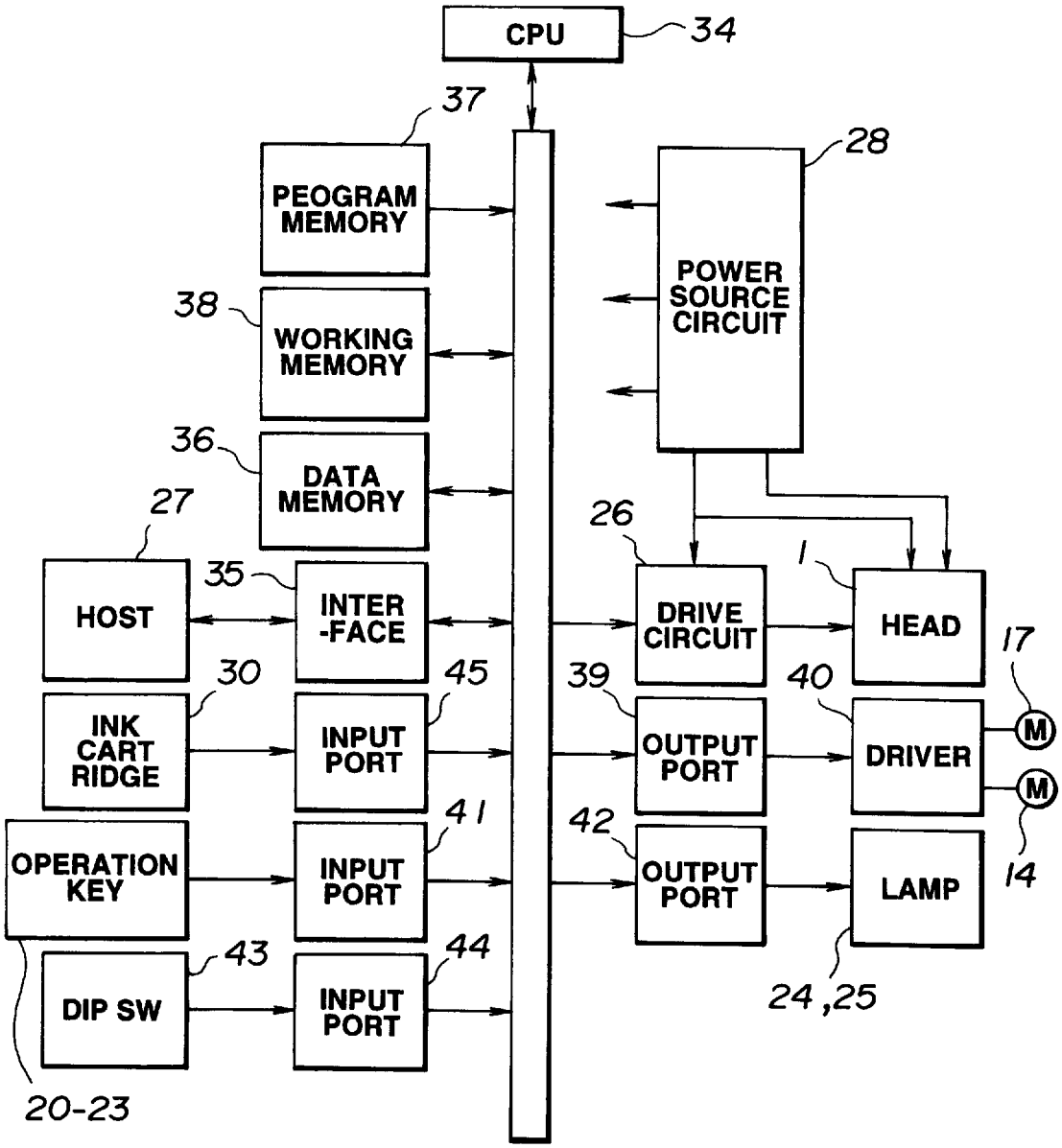
FIG. 3 is a schematic block diagram for explaining a control system of the ink jet printing apparatus shown in FIG. 1.

FIG. 3 is a schematic block diagram for explaining a control system of the ink jet printing apparatus shown in FIG. 1.

In FIG. 3, the CPU 34 comprises a microprocessor connected to the host apparatus 27 through an interface 35. The CPU 34 controls the printing operation on the basis of the command signal and the printing information signal sent from a controller of the host apparatus 27 and stored in a data memory 36, a program stored in a program memory 37 comprised by a ROM and stored in a working memory 38 constituted by a RAM, and printing command data.

The CPU 34 controls the carriage motor 17 and the transfer motor 14 through an output port 39 and a motor driver 40. The CPU 34 also controls the printing operation of the printing head 1 through a driving circuit 26 on the basis of printing information stored in the data memory 36.

Output from each of the operation keys 20, 21, 22 and 23 (see FIG. 1) on the operation panel 19 is sent to the CPU 34 through an input port 41. Control signals are supplied to a warning lamp such as the alarm lamps 24 and a power source lamp 25 through the output port 42 from the CPU 34. A DIP switch 43 provided on the bottom surface of the printing apparatus sends its output to the CPU 34 through an input port 44.

In FIG. 3, a logic drive voltage (for example, 5V) for operating the control logic circuitry, a drive voltage (for example, 30V) for driving the motor, a reset voltage, a head voltage VH (for example, 25V) for electrifying and heating the electrothermal converters of the printing head 1, and a backup voltage for protecting the printing head 1 are supplied from the power source circuit 28. The head voltage is supplied to the printing head 1, and the backup voltage is supplied to the drive circuit 26 and the printing head, respectively.

In the control system shown in FIG. 3, there is a mechanism in which a property of the ink, such as color or density, obtained from the ink cartridge 30 is sent to the CPU 34 through an input port 45. This mechanism can be mechanical, in which the property is represented by a unique pattern of cut-outs on the cartridge read when the cartridge is mounted on the apparatus. It can also be electrical, in which the property is represented by a resistance determined when the cartridge is mounted on the apparatus.

Figure 4:
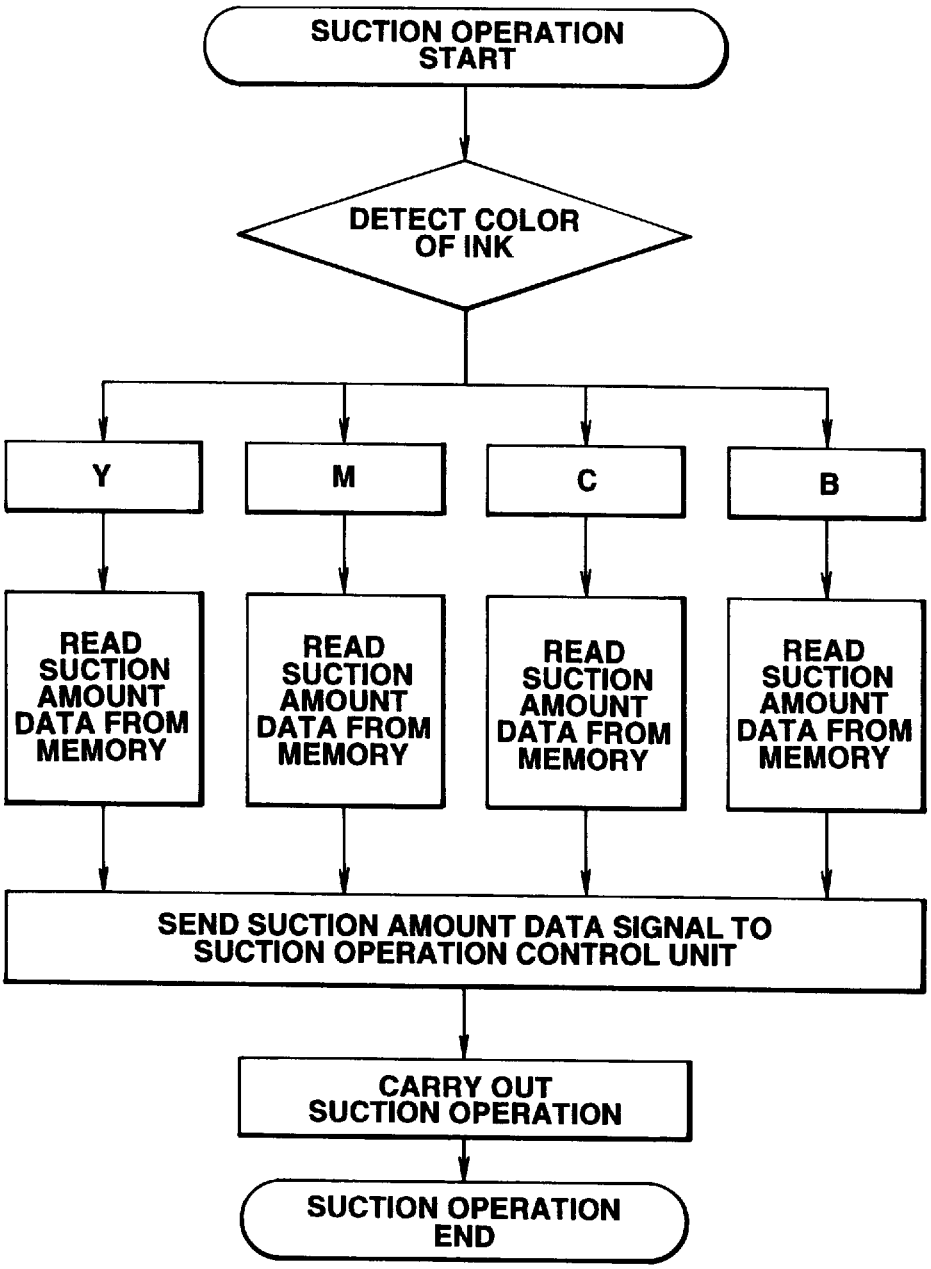
FIG. 4 is a flow chart for explaining the control of the ink suction from the discharge port of a printing head in accordance with the present invention.

FIG. 4 shows a flow chart for explaining the control of the ink suction from the discharge ports of the printing head 1, carried out by the ink suction operation control unit 31. In FIG. 4, when the ink jet printing apparatus performs the ink suction operation, that is, when the ink suction operation control routine starts, the ink data from the ink cartridge 30 connected to the printing head 1 is detected by the ink data detecting means 32. The detected ink data is sent to the ink suction operation control unit 31.

The ink suction operation control unit 31 refers to the memory 33 in which a necessary ink suction amount data corresponding to the ink data are stored, and then determines the necessary ink suction amount on the basis of the detected ink data. Next, the ink suction operation control unit 31 performs the ink suction operation on the designated printing head 1 in accordance with the stored suction amount.

In the above embodiment, the ink suction amount is determined on the basis of the ink color, since different color ink will have different properties. However, the ink suction amount may be determined on the basis of the density of the ink, or any other relevant property.

According to the above embodiment described using FIGS. 1 to 5, when the ink suction operation or recovering ink discharge condition is performed, the ink suction amount is determined in accordance with the ink data. Therefore, the proper ink suction operation corresponding to the ink in the cartridge can be performed, whereby insufficient ink suction excessive ink suction can be avoided. As a result, reliable ink discharge recovery can be performed and waste of ink and energy can be avoided.

Figure 6:
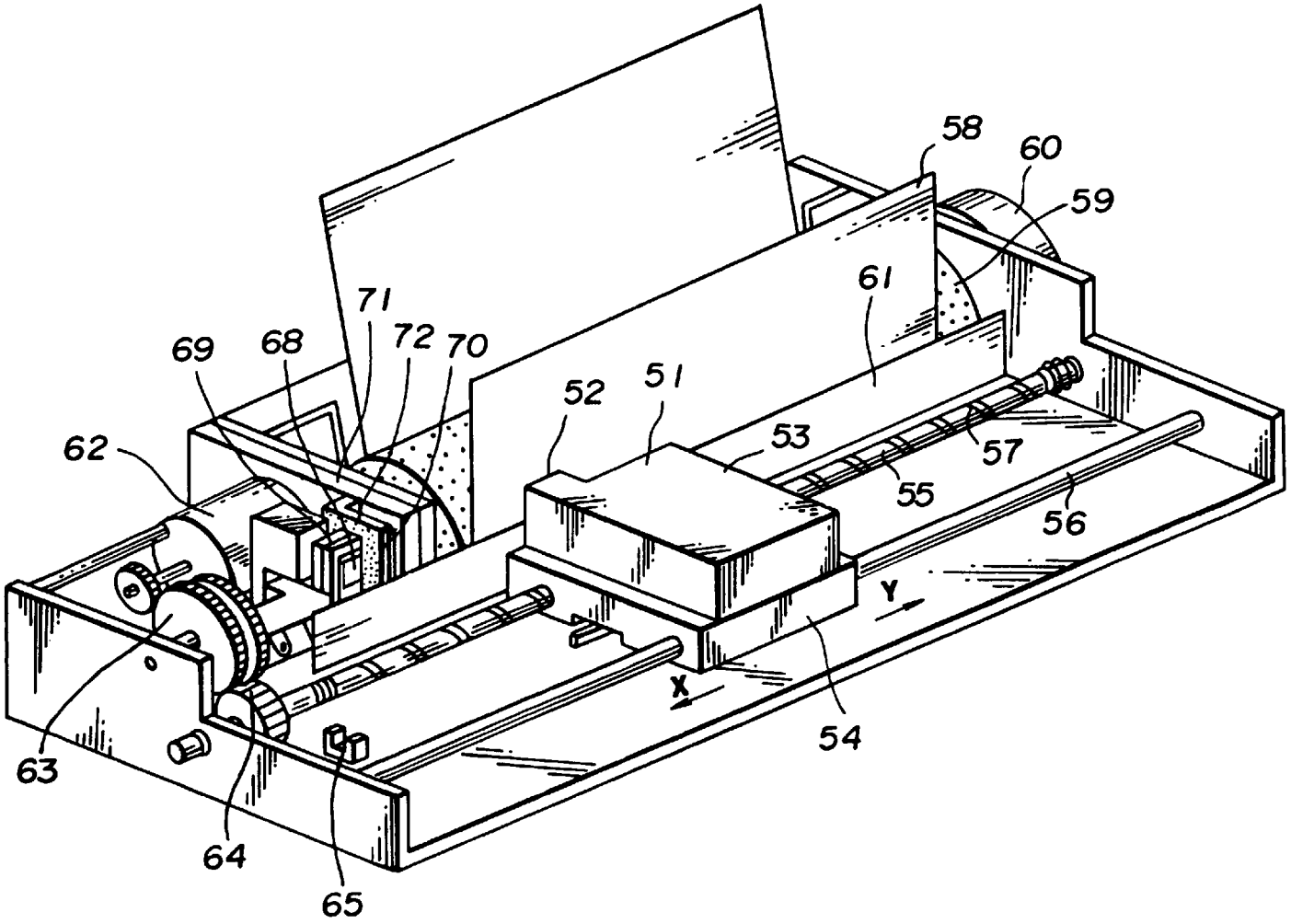
FIG.6 (PRIOR ART)
FIG. 6 is a schematic perspective view of embodiment of a conventional ink jet printing apparatus.
Figure 7:
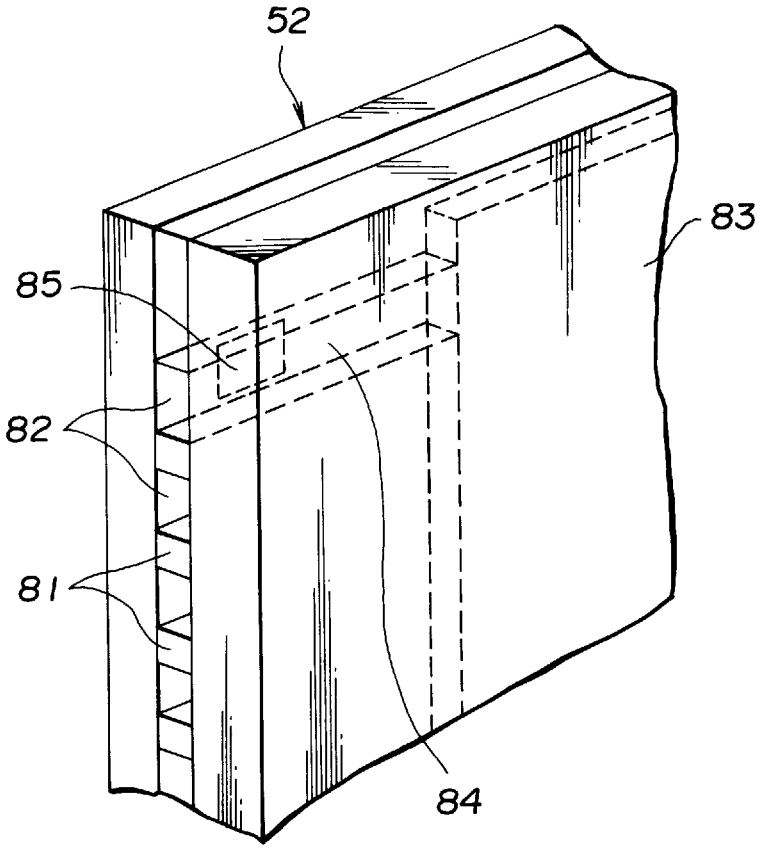
FIG.7 (PRIOR ART)
FIG. 7 is a schematic perspective view of the ink discharge portion of a conventional printing head used in the printing apparatus of FIG. 6.
Figure 8A:
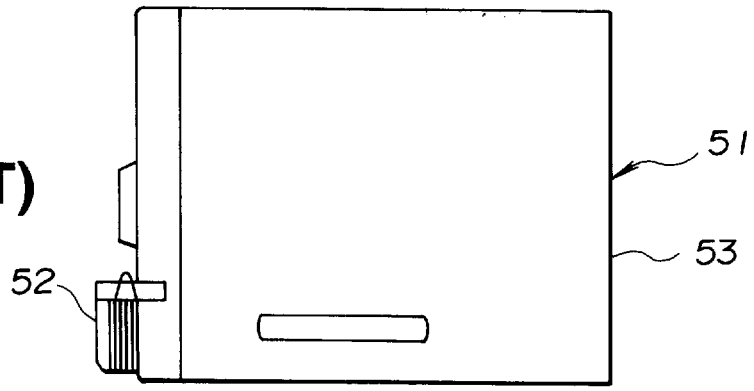
FIG.8(A) (PRIOR ART)
FIGS. 8(A)–8(D) show a conventional head cartridge used in the printing apparatus of FIG. 6.
Figure 8B:
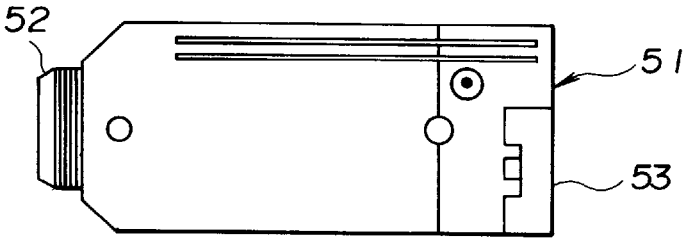
FIG.8(B) (PRIOR ART)
Figure 8C:
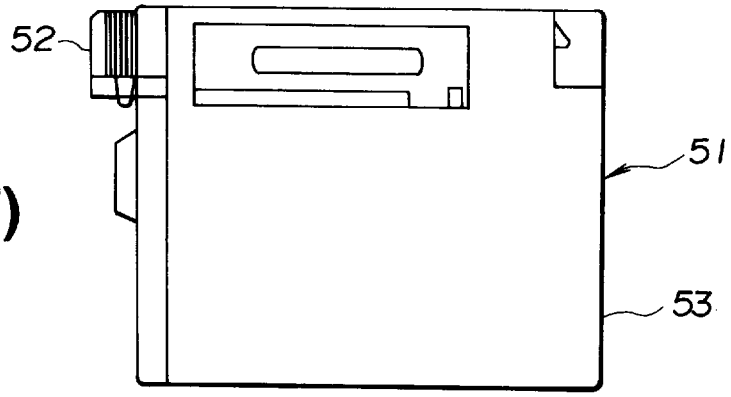
FIG.8(C) (PRIOR ART)
Figure 8D:
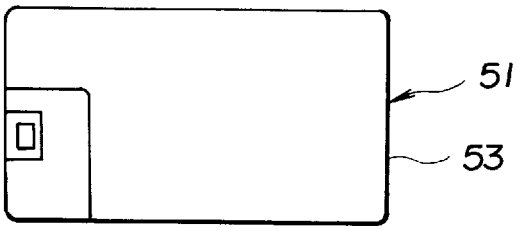
FIG.8(D) (PRIOR ART)
Figure 9:
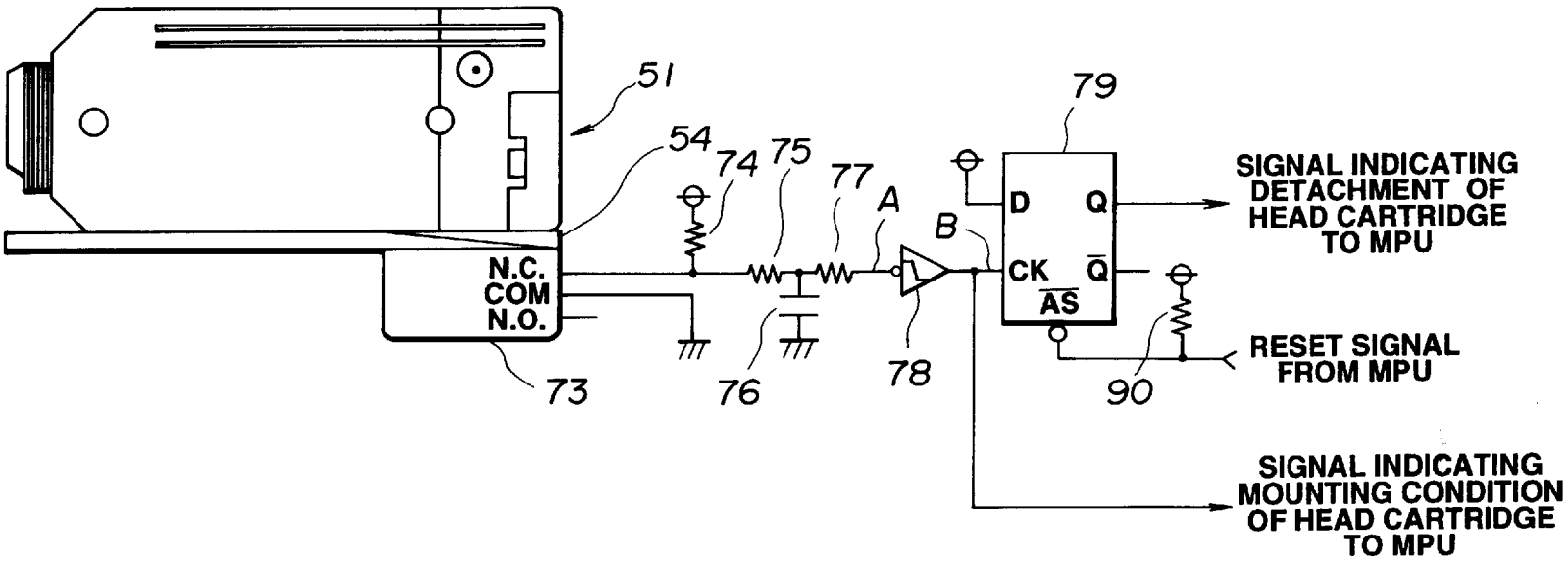
FIG. 9 is a schematic view for illustrating another embodiment of the invention, involving a mounting condition of a head cartridge on a carriage and circuitry for detecting same.
Figure 10:
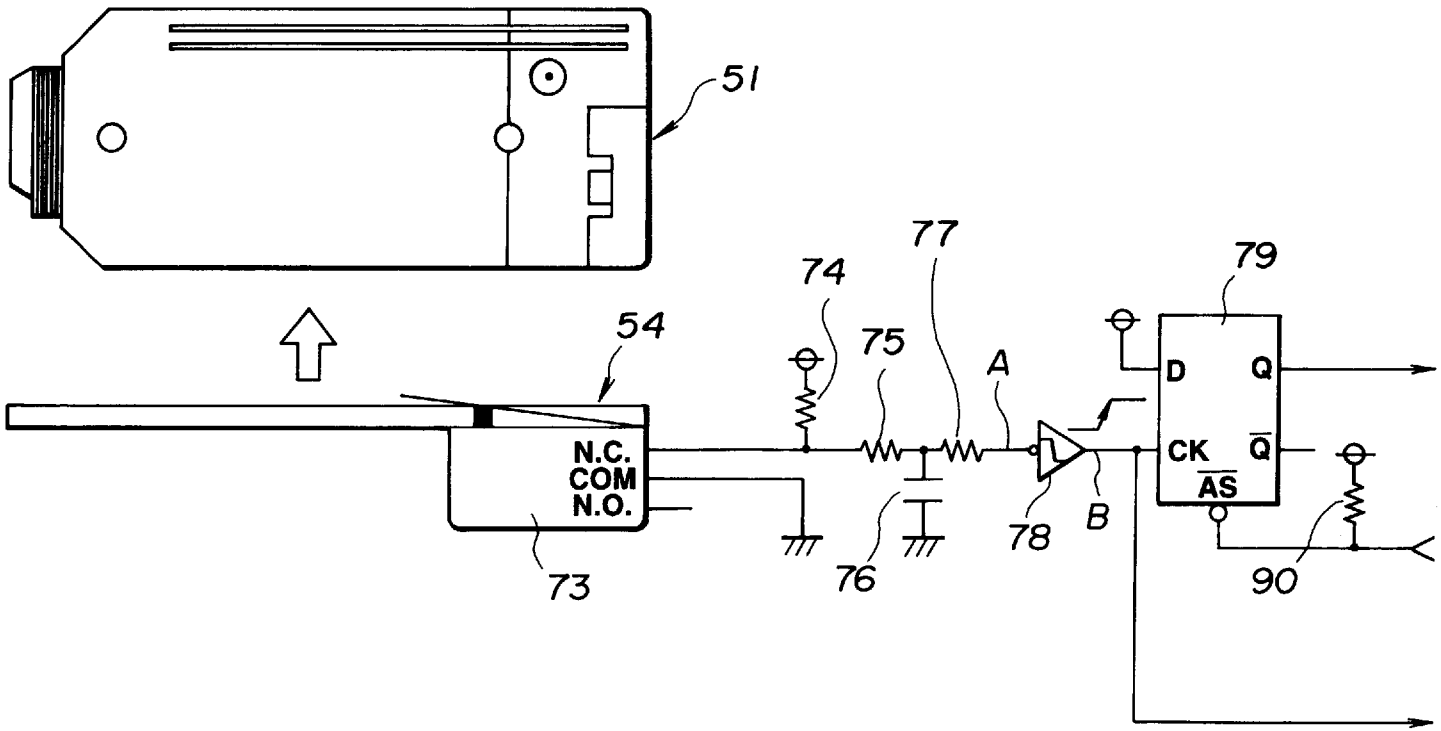
FIG. 10 is a schematic view showing the head cartridge detached from the carriage.

FIG. 9 is a schematic view for explaining a state in which the head cartridge 51 (FIG. 6) is mounted on the carriage 54. FIG. 10 is a schematic view for explaining a state in which the head cartridge 51 is detached from the carriage 54.

In FIGS. 9 and 10, a microswitch 73 operates when the head cartridge 51 is mounted on the carriage 54. Reference numeral 74 denotes a pull-up resistance, reference numeral 75 denotes an electric resistance, reference numeral 76 denotes a condenser for preventing chattering, reference numeral 77 denotes a resistor for protecting the input of an inverter 78 with a Schmidt trigger, reference numeral 79 denotes a D-type flip-flop and reference numeral 90 denotes a pull-up resistance.

FIG. 9 shows the head cartridge 51 mounted on the carriage 54, and in this state, the microswitch 73 is turned on. When the microswitch 73 is turned on, its NC and COM terminals are not electrically connected. As a result, the level of the input A of the inverter 78 is "H", and thus the level of the output B of the inverter 78 is "L". Since the flip-flop 79 does not accept the "L" signal as an input signal, the level of the output Q of the flip-flop 79 is "L".

FIG. 10 shows a condition in which the head cartridge 51 has been detached from the carriage 54, and therefore the microswitch 73 returns to its original position. In this condition, the NC terminal and the COM terminal of the microswitch 73 are connected. As a result, input A of the inverter 78 becomes "L" and its output B becomes "H". The input CK of the flip-flop 79 accepts the signal when it changes to "H" from "L", and therefore the MPU receives an "H" signal from the output Q, which means that the head cartridge 51 has been detached.

Since the pull-up resistance 74, the inverter 78 and the flip-flop 79 consume very little power, they can be driven by a battery even if power is not supplied to the printing apparatus from a power source. Therefore, even if the power switch of the printing apparatus is turned off, the detachment of the head cartridge 51 can be detected and stored in memory.

When the power switch of the printing apparatus is turned on, the MPU checks the mounting condition of the head cartridge 51. If the MPU confirms that a head cartridge is mounted, and that the head cartridge 51 was detached during the interim when the power was off, the MPU activates the ink discharge recovery system to remove any clogging in the discharge ports of the head cartridge 51 and restore it to normal condition. After the ink discharge recovery operation is finished, the MPU sends a reset signal to the flip-flop 79.

The ink discharge recovery operation is performed, for example, by a suction recovery operation in which the discharge ports are sealed by a cap and the inside of the cap is maintained in a negative pressure condition using a pump so that ink is sucked from the discharge port, or by a pressure recovery operation in which ink in the head is pressurized and forced out of the discharge port, or by a wiping recovery operation in which foreign material such as ink and dust on the discharge port surface is wiped and removed by a rubber blade.

Figure 11:
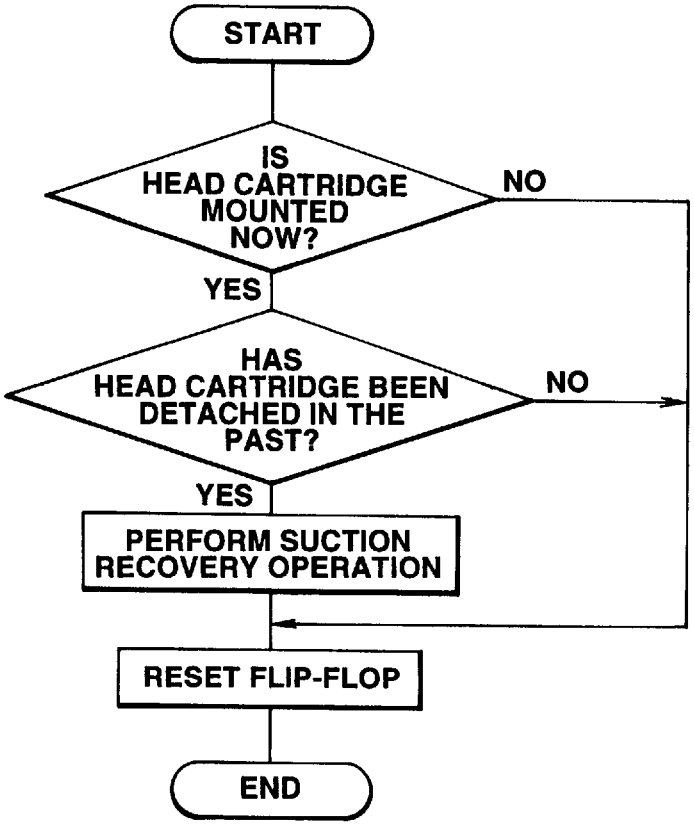
FIG. 11 is a flowchart illustrating an ink discharge recovery operation according to this embodiment of the invention.

FIG. 11 is a flowchart for explaining the above-described ink discharge recovery operation.

As described hereinbefore, the ink jet printing apparatus shown in FIGS. 9 and 10 has means for detecting a previous detaching of the head cartridge 51 and for confirming that a head cartridge is mounted. Regardless of the state of the power switch of the printing apparatus, detachment of the head cartridge 51 can be detected and memorized and the ink discharge recovery operation is automatically conducted on the basis of the memorized condition when the power switch of the printing apparatus is turned on.

According to the above-described embodiment, even if the head cartridge is exchanged while the power switch is turned off, ink discharge recovery can be automatically carried out when the power switch is turned on, whereby the normal ink discharge condition can be maintained and the fine printing can be performed.

Figure 12:
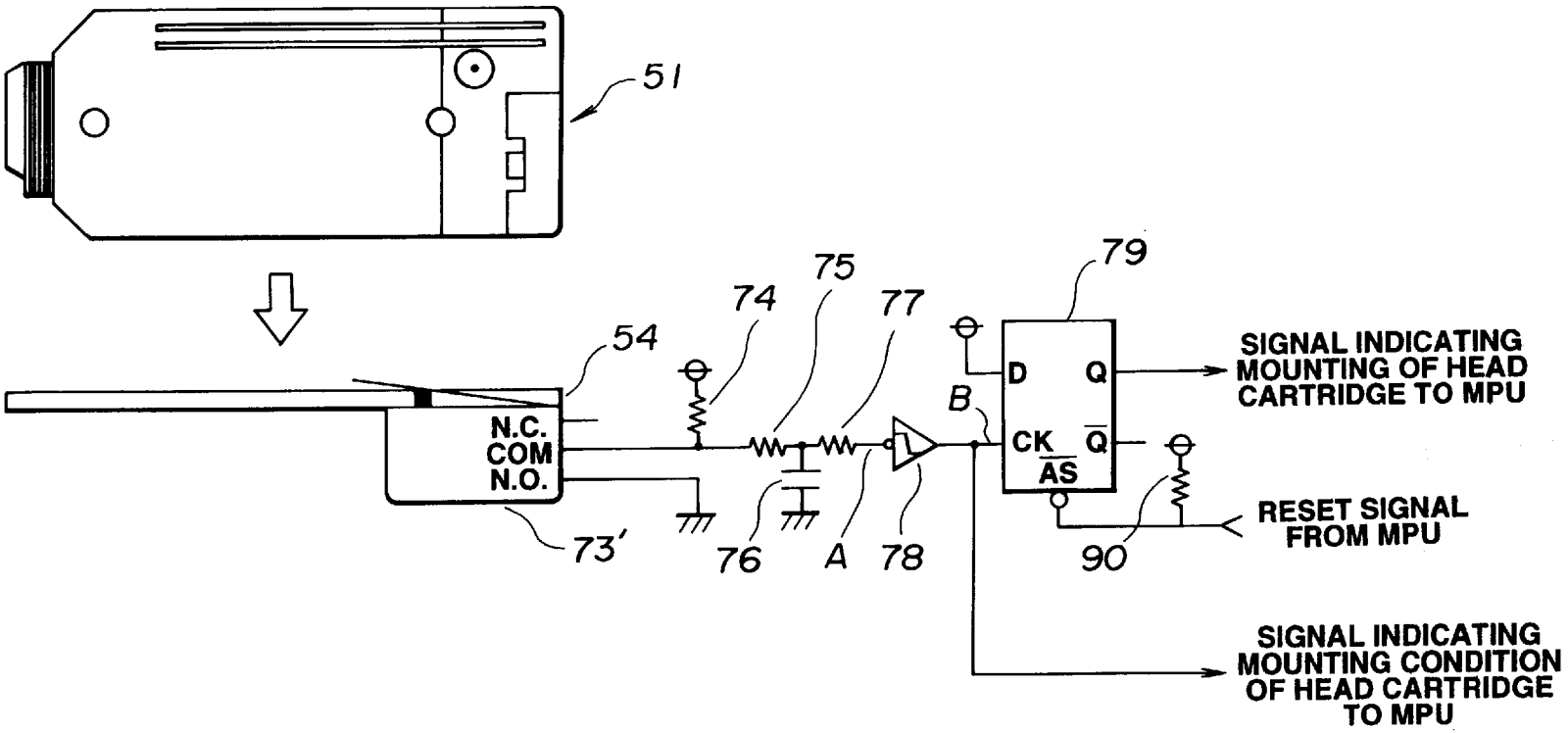
FIG. 12 is a schematic view showing yet another embodiment of the invention, involving another mounting condition for a head cartridge and circuitry for detecting same.
Figure 13:
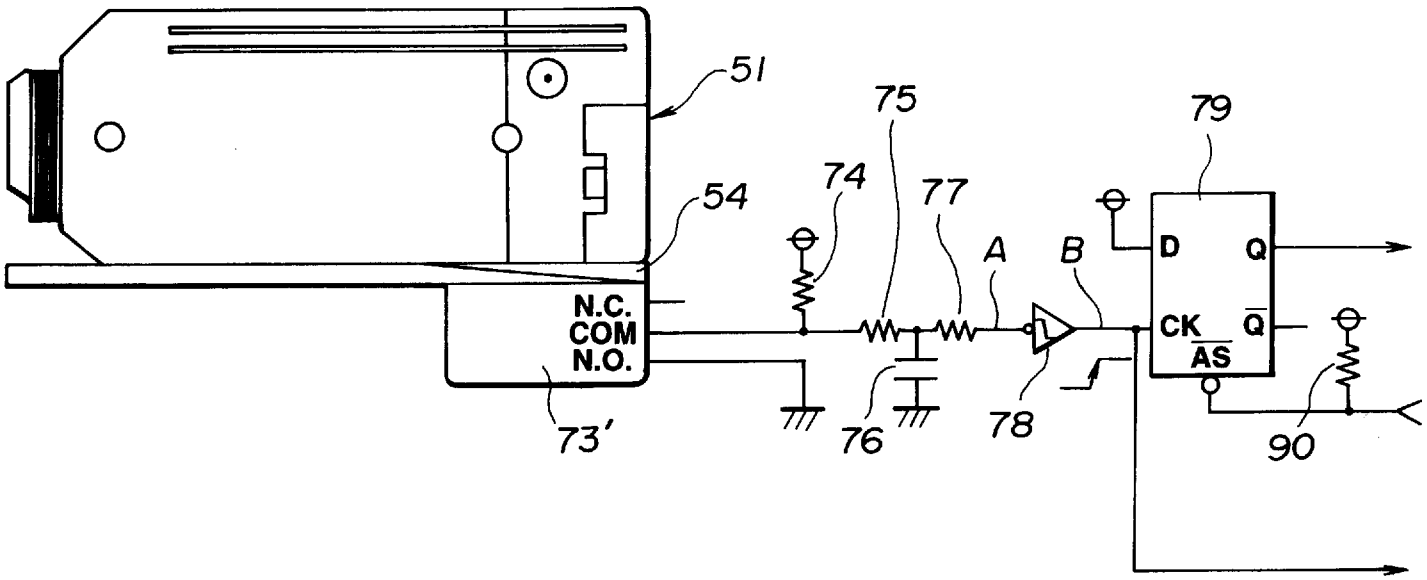
FIG. 13 is a schematic view showing the head cartridge mounted on the carriage.
Figure 14:
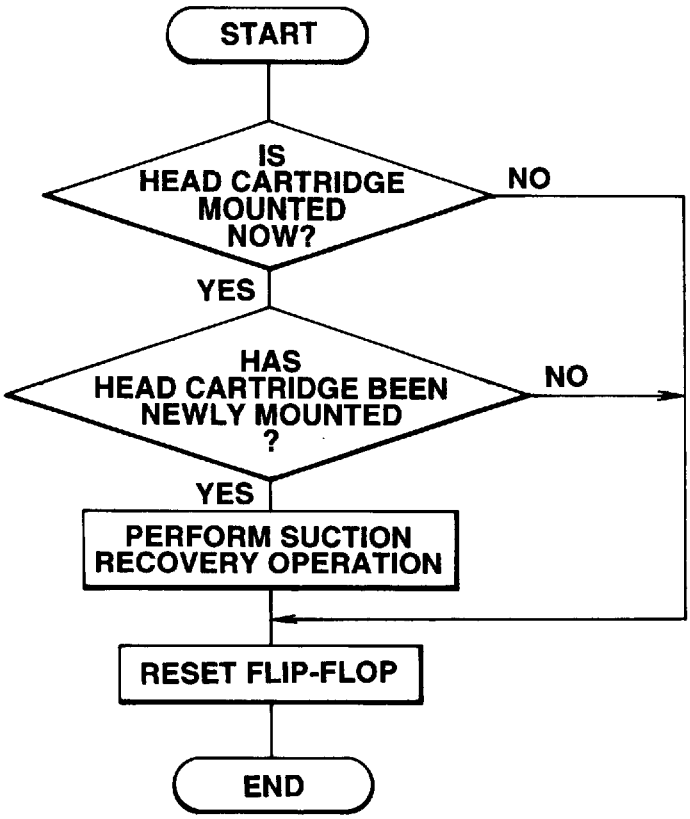
FIG. 14 is a flowchart illustrating an ink discharge recovery operation according to this embodiment of the invention.

FIG. 12 is a schematic view of another aspect of this embodiment of the present invention, in which the head cartridge 51 is detached from the carriage 54. FIG. 13 is a schematic view for explaining a state in which a head cartridge 51 is mounted on the carriage 54. FIG. 14 is a flowchart for explaining the ink discharge recovery operation carried out in accordance with the aspect of the invention depicted in FIGS. 12 and 13. The detecting circuitry shown in FIGS. 12 and 13 is the same as that shown in FIGS. 9 and 10.

In FIGS. 9 to 11, detachment of the head cartridge is detected and memorized and the ink discharge recovery operation is carried out. In FIG. 12 to 14, mounting of a head cartridge is detected and stored in a memory and the ink discharge recovery operation for the discharge port is carried out in accordance with such detection.

FIG. 12 shows a state in which a head cartridge 51 is not mounted on the carriage 54, and in this state the microswitch 73' is turned off. In this embodiment, the COM terminal and the NC terminal of the microswitch 73' are not electrically connected. As a result, the input A of the inverter 78 is "H" due to the pull-up resistance 74 and the output B of the inverter 78 is "L". The flip-flop 79 does not accept the "L" signal as an input signal, so the output Q of the flip-flop 79 is "L".

FIG. 13 shows the state in which the head cartridge 51 has been mounted on the carriage 54, and therefor the microswitch 73' is turned on. In this state, the COM terminal and the NC terminal of the microswitch 73' are connected. As a result, the input A of the inverter 78 becomes "L" and the output B of the inverter 78 becomes "H". Since the flip-flop 79 accepts an "H" signal at its CK input, the output Q of the flip-flip 79 goes to "H" from "L", and therefore the MPU receives a signal indicating that the head cartridge 51 is mounted.

Since the pull-up resistance 74, the inverter 78 and the flip-flop 79 consume little power as stated above, they can be driven by a battery even if power is not supplied to the printer apparatus from a power source. Therefore, even if the power switch of the printer apparatus is turned off, the MPU can check whether a head cartridge 51 has been mounted on the apparatus during the period when the power was off. If the MPU confirms that a head cartridge 51 was mounted, the MPU causes the ink discharge recovery system to operate. The ink discharge recovery operation is similarly performed as stated in the foregoing.

In addition, when the power switch of the printing apparatus is turned on, the MPU can confirm the present mounting condition of the head cartridge 51. If the MPU confirms that the head cartridge 51 is now mounted on the carriage 54 and was mounted while the power was off, the MPU may control the ink discharge recovery system to recover any clogging in the discharge ports of the head cartridge 51, and send a reset signal to the flip-flip 79 after the ink discharge recovery operation is finished.

FIG. 14 is a flow-chart for explaining the above-described ink discharge recovery operation.

As described hereinbefore, the ink jet printing apparatus shown in FIGS. 12 and 13 has means for detecting mounting of the head cartridge 51. Therefore, even if a head cartridge is mounted while the power switch of the printing apparatus is turned off, the ink discharge recovery operation can be automatically carried out when the power switch is turned on, whereby the normal ink discharge condition can be maintained and fine printing can be performed. This feature can provide for automatically performing a discharge recovery operation upon initial mounting of a head cartridge, such as when the apparatus is shipped with the head cartridge packed separately for mounting by the user.

The means for detecting the detachment or the mounting of the head cartridge 51 shown in the foregoing figures is not limited to that illustrated, and various modifications can be made in that circuitry. Moreover, the printing head can be single or plural (so as to print colors or a gradational image).

The present invention brings about excellent effects particularly in using a print head of the bubble jet system proposed by Canon Inc., which performs printing by forming fine ink droplets by the use of thermal energy.

As a representative constitution and principle, for example, the basic principle disclosed in, for example, U.S. Pat. Nos. 4,723,129 and 4,740,796 is preferred. Particularly, on-demand type printing is effective because, by applying at least one driving signal which gives rapid temperature elevation exceeding nucleate boiling, electricity-heat converters, arranged corresponding to sheets or liquid channels holding a liquid (ink), generate thermal energy to effect film boiling at the heat acting surface of the recording head. Consequently, bubbles with the liquid (ink) can be formed in one-to-one correspondence to the driving signals. By discharging the liquid (ink) through an opening for discharging by growth and shrinkage of the bubble, at least one droplet is formed. By making the driving signals into desired pulse shapes, growth and shrinkage of the bubbles can be effected in a manner that discharges the liquid (ink) with particularly excellent response characteristics.

As the driving signals of such pulse shape, those disclosed in U.S. Pat. Nos. 4,463,359 and 4,345,262 are suitable. Further excellent recording can be performed using the conditions described in U.S. Pat. No. 4,313,124 concerning the temperature elevation rate of the above-mentioned heat acting surface.

As the constitution of the recording head, in addition to the combination of the discharging port, liquid channel, and electricity-heat converter (linear liquid channel or right-angled liquid channel) as disclosed in the above-mentioned respective specifications, the constitution shown in U.S. Pat. No. 4,558,333 or U.S. Pat. No. 4,459,600, disclosing the heat acting portion arranged in a flexed region, is also included in the present invention.

In addition, the present invention can also effectively use the constitution disclosed in Japanese Laid-Open Patent Application No. 59-123670, which uses a slit common to a plurality of electricity-heat converters as the discharging portion of the electricity-heat converter, or Japanese Laid-Open Patent Application No. 59-138461, which has an opening for absorbing a pressure wave from the heat energy corresponding to the discharging portion.

In addition, the present invention is effective for a recording head of the freely exchangeable chip type, which enables electrical connection to the main device or supply of ink from the main device by being mounted on the main device, or a recording head of the cartridge type having an ink tank integrally provided on the recording head itself.

Also, addition of a restoration means for the recording head, a preliminary auxiliary means, etc., provided as the constitution of the recording device of the present invention is preferable, because the effect of the present invention can be further stabilized. Specific examples of these may include, for the recording head, capping means, cleaning means, pressurization or suction means, electricity-heat converters or another type of heating elements, or preliminary heating means according to a combination of these. It is also effective for ensuring stable recording to perform preliminary ink discharge which involves ink discharging separate from recording.

In addition, though the ink is considered as the liquid in the embodiments as above described, the ink may be in a solid state below room temperature as long as the ink will soften or liquify at or above room temperature, or liquify when a recording signal is applied to it. It is common in such an ink jet device to control the viscosity of the ink to be maintained within a certain range for stable discharge by adjusting the temperature of the ink in a range from 30° to 70° C.

In addition, in order to avoid the temperature elevation due to heat energy by positively utilizing the heat energy as the energy for the change of state from solid to liquid, or to prevent the evaporation of ink by using ink that is solid under normal storage conditions, ink having a property of liquefying only with the application of heat energy, such as liquefying with the application of heat energy in accordance with a recording signal and solidifying prior to reaching a recording medium, is also applicable in the present invention. In such a case, the ink may be held as liquid or solid in recesses or through holes of a porous sheet, which is placed opposed to electricity-heat converters, as described in Japanese Laid-Open Patent Application No. 54-56847 or No. 60-71260. The most effective method for the ink as above described in the present invention is based on film boiling.

Additionally, a printing apparatus provided with a recording mechanism using an ink jet printing apparatus according to the present invention may include an image output terminal of an information processing unit such as a computer, as well as a copying machine combined with a reader, etc., and a facsimile machine having a transmission/receiving function.

Figure 15:
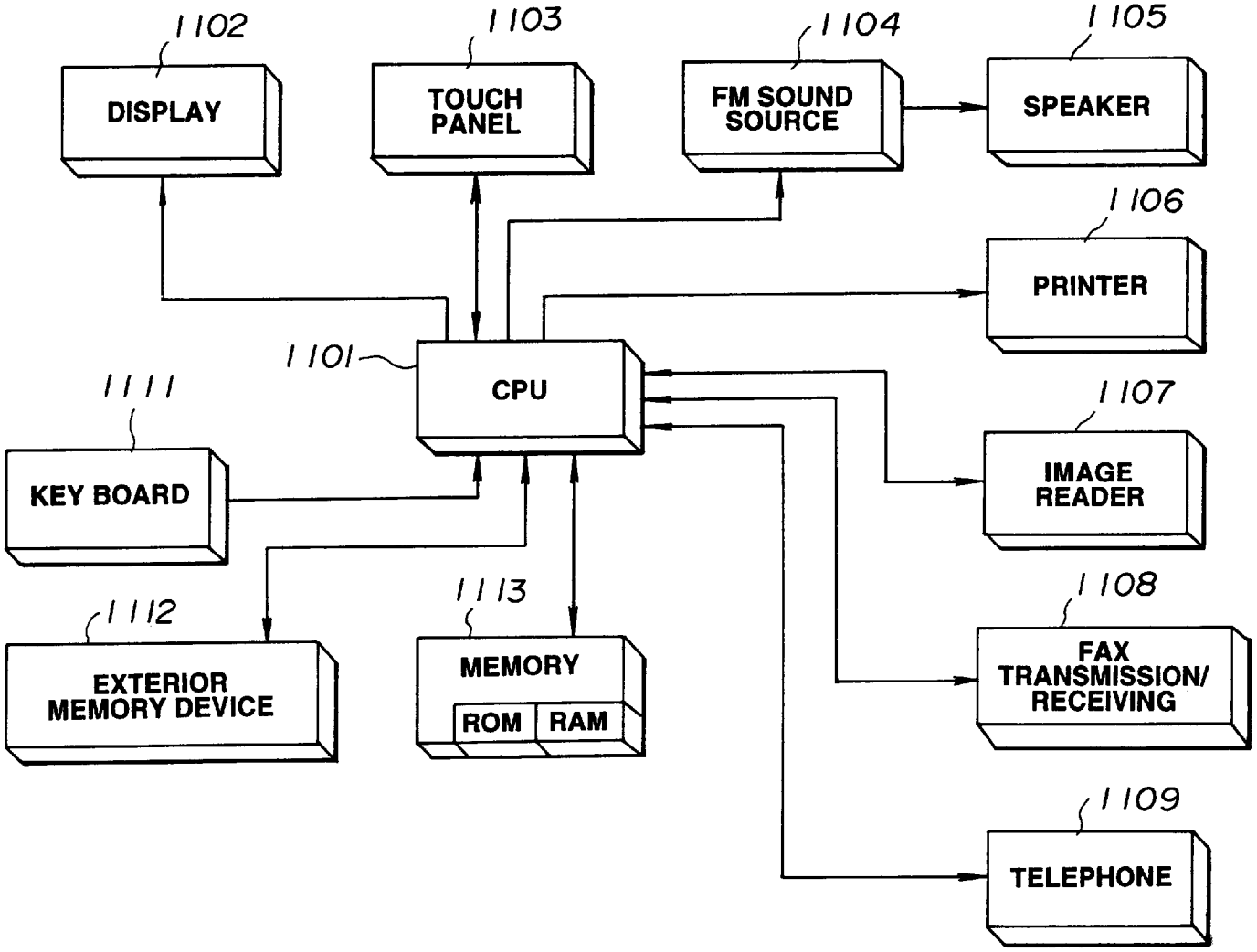
FIG. 15 is a schematic block diagram of an information processing unit to which the present invention has been applied.

FIG. 15 is a block diagram showing a schematic construction of an information processing unit capable of functioning as a word processor, a personal computer, a facsimile machine and a copying machine, to which the recording apparatus of the present invention is applied.

In FIG. 15, 1101 denotes a control part for controlling the whole of an apparatus which is provided with a CPU such as a microprocessor or various kinds of I/O parts, and serves to output control signals or data signals to various parts or to input control signals or data signals from various parts. Numeral 1102 is a display using a display image screen on which various types of menus, document information and image data read by an image reader number 1102 or the like are displayed. Numeral 1103 is a transparent and pressure sensitive touch panel which is provided on the display 1102 and which an operator uses by depressing the surface with a finger.

Numeral 1104 denotes an FM (frequency modulation) sound source part which stores as digital data music information prepared by a music editor or the like in a memory 1113 or an exterior memory device 1112, reads it from the memories and performs FM modulation. An electric signal outputted from the FM sound source part 1104 is converted into audible sound by a speaker 1105. A printer part 1106 to which a recording apparatus of the present invention is applied is used as an output terminal of a word processor, a personal computer, a facsimile machine and a copying machine.

Numeral 1107 denotes an image reader, which serves to photoelectrically read input original documents, and can read facsimile originals and copied originals as well as other various kinds of originals. Numeral 1108 designates a transmission/receiving part of a facsimile (FAX), which serves to code and send or to receive and decode facsimile transmissions of the original data read by the image reader 1107 or a transmitted facsimile signal, and is provided with an interface function with an exterior side. Numeral 1109 is a telephone part having a variety of functions, such as operation as an ordinary telephone, a caretaking telephone, etc.

Numeral 1113 designates a memory including a ROM which stores a system program or manager program and other application programs, or character fonts, dictionaries, etc., an application program loaded from the exterior memory device 1112, document information, a video RAM or the like.

Numeral 1111 is a keyboard which serves to input document information, various kinds of commands or the like.

The exterior memory device 1112 uses a floppy disk or a hard disk, etc., as a recording medium that can be loaded with document information, music or sound information or the application program of a user, etc.

Figure 16:
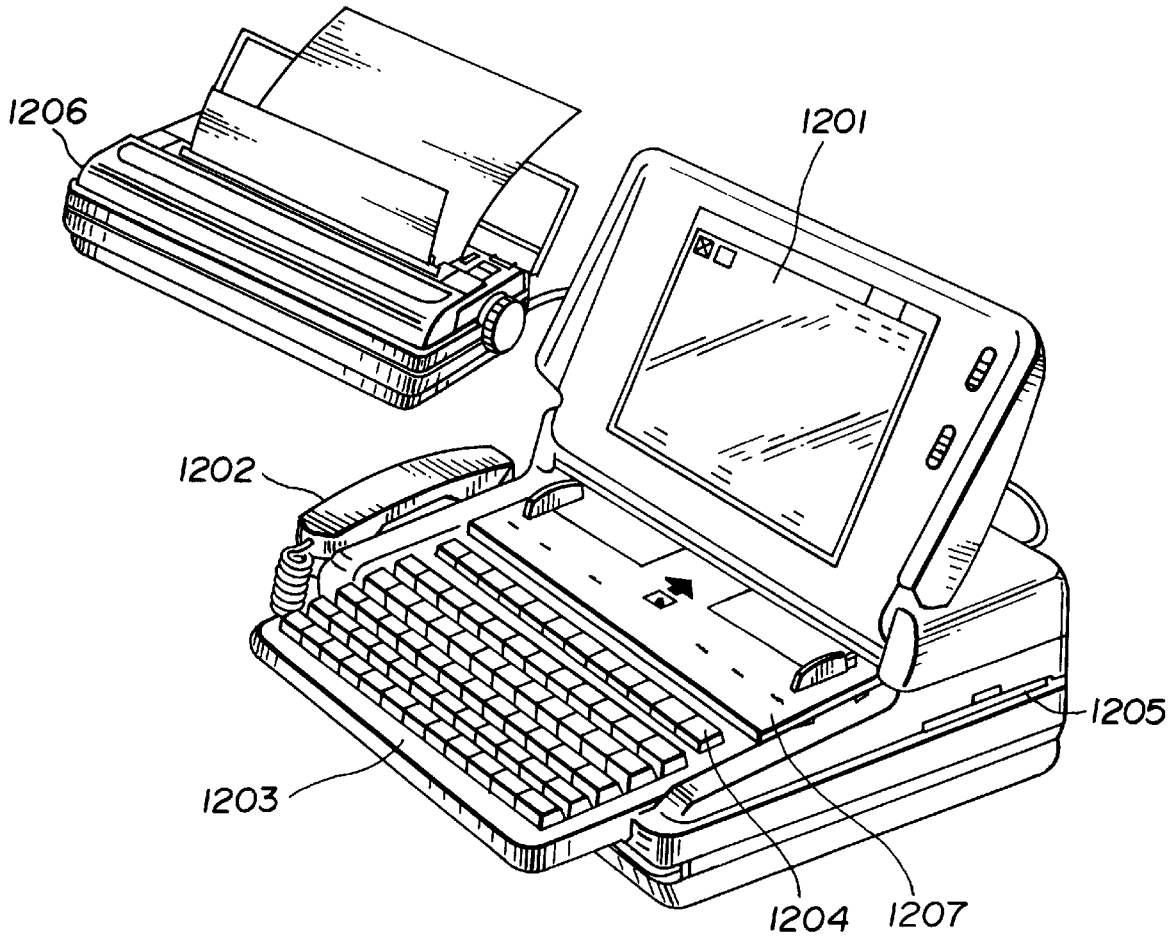
FIG. 16 is a perspective view of the information processing unit shown in block form in FIG. 15.

FIG. 16 depicts a typical information processing unit shown in block diagram form in FIG. 15.

In FIG. 16, 1201 is a flat panel display using a liquid crystal device or the like and serves to display various menus or graphic information and document information, etc. The touch panel is disposed on this display 1201 and coordinates can be inputted or items can be specified and inputted through depression of the surface of the touch panel by using a finger. Numeral 1202 is a handset employed when the unit functions as a telephone. A keyboard 1203 is detachably connected to the main body of the information processing unit and is capable of inputting all sorts of document information and different data. Numerous function keys or the like 1204 are included on the keyboard 1203, and numeral 1205 indicates an insert port for inserting a floppy disk into the exterior memory device.

Numeral 1207 designates a paper mounting part for mounting the original to be read by the image reader 1107. The read original is ejected from a back side of the information processing unit. A received facsimile or the like is recorded by an ink jet printer 1206.

The display 1201 may be a CRT type, but is preferably in the form of a flat panel such as a liquid crystal display making use of a ferroelectric liquid crystal, because that way a compact, thin and light display can be obtained.

In the case where the above information processing unit functions as a personal computer or a word processor, various types of information inputted from the keyboard are processed in accordance with a prescribed program by the control part 1101 and outputted to the printer part 1108 as an image.

In the case where the information processing unit operates as a receiver of a facsimile machine, facsimile information inputted from the FAX transmission/receiving part 1108 through a communication line is received and processed by the control part 1101 in accordance with a prescribed program and outputted to the printer part 1106 as a received image.

In the case where the information processing unit serves as a copying machine, an original is read by the image reader 1107 and the read original data is outputted to the printer part 1106 as a copied image through the control part 1101. In the case where the information processing unit functions as a transmitter for the facsimile machine, the original data read by the image reader 1107 is transmitted and processed by the control part 1101 in accordance with a prescribed program and then transmitted to the communication line through the FAX transmission/receiving part 1108.

Figure 17:
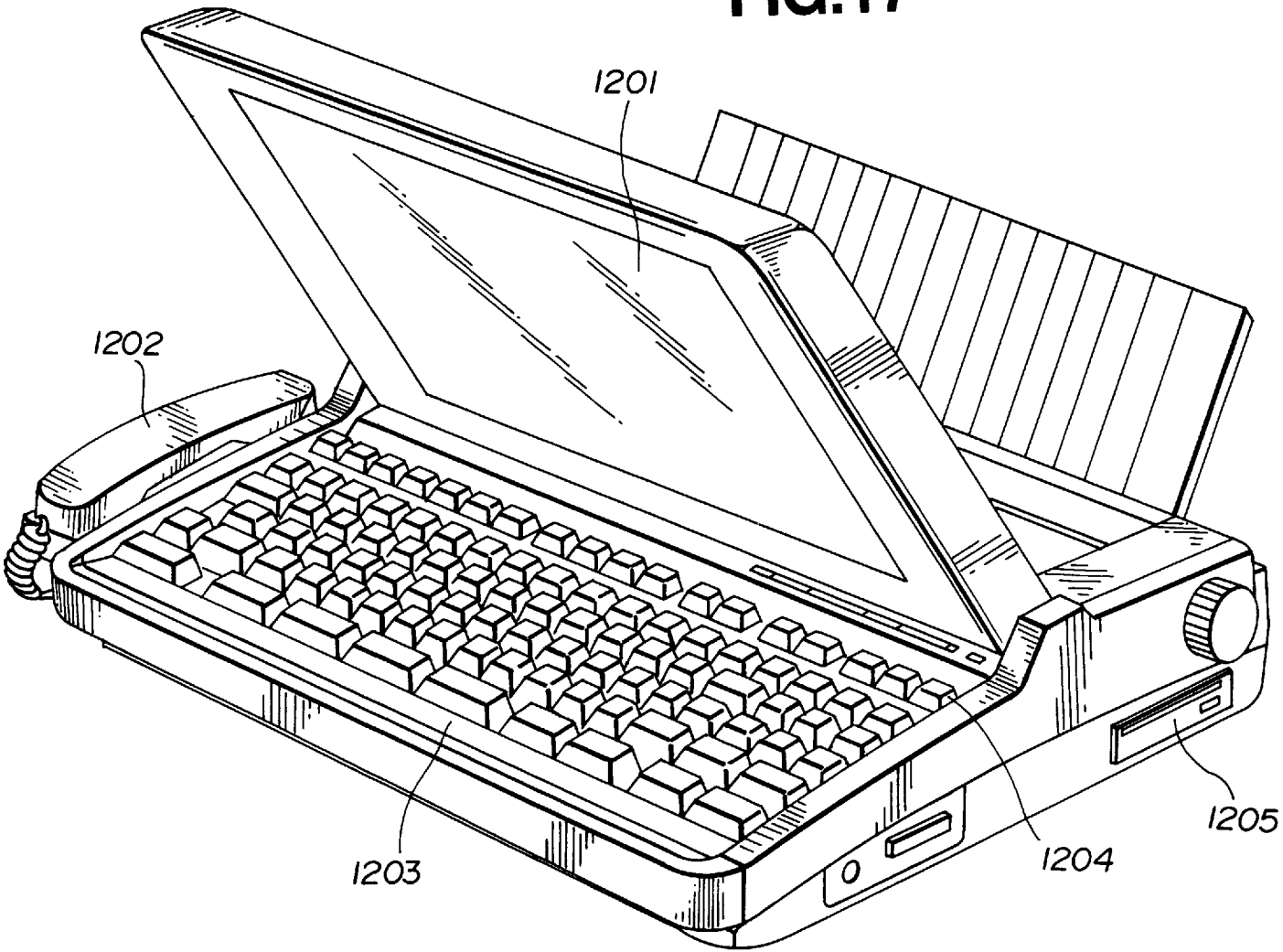
FIG. 17 is a perspective view of a unitary information processing unit.

The information processing unit described above may be a unitary type in which an ink jet printer is built in the main body as illustrated in FIG. 17. In this case, the portability of the information processing unit can be improved. In this figure, portions having the same functions as those in FIG. 16 are marked by corresponding reference numerals.

Since a recorded image of high definition can be obtained by the application of the apparatus of the present invention to the multifunctional information processing unit as set forth above, the functions of the information processing unit can be further enhanced.

It will be appreciated that the present invention has been disclosed in connection with numerous preferred embodiments thereof. Modifications and alternations other than those specifically noted can be made without departing from the spirit or scope of the invention as delineated in the following claims.

What is claimed is:

1. An ink jet printing apparatus for recording an image onto a recording medium, said apparatus comprising:

a plurality of printing means for discharging ink onto the recording medium, each said printing means having a discharge opening for discharging ink therethrough;

recovery means for recovering and maintaining an ink discharge condition of each of said plurality of printing means by exhausting ink from the respective discharge openings, using a single recovery device;

storage means for storing data with respect to the amounts of respective ink to be exhausted by said recovery means, said storage means storing the data in accordance with a property of the ink, and said recovery means setting conditions for recovery operation in accordance with data regarding the property of the ink read from said storage means; and control means for controlling operation of said recovery means so that in recovering and maintaining an ink discharge condition of each said printing means, a recovery operation is performed by exhausting an adequate amount of ink in accordance with the property of ink in said respective printing means on the basis of the data stored in said storage means.

2. An ink jet printing apparatus according to claim 1, wherein each said printing means includes electrothermal converters for generating heat energy to eject droplets of ink toward the recording medium.

3. An ink jet recording apparatus according to claim 1, further comprising discriminating means for discriminating an property of ink in each said printing means to be recovered by said recovery means.

4. A ink jet printing apparatus according to claim 3, wherein said discriminating means discriminates a density of the ink.

5. An ink jet printing apparatus according to claim 4, wherein said discriminating means discriminates a color of the ink.

6. An ink jet recording apparatus according to claim 1, further comprising image reading means for reading an original image to be printed on the recording medium by said plurality of printing means.

7. An ink jet recording apparatus according to claim 1, further comprising image information signal transmitting means for transmitting signals representing the image to be printed on the recording medium by said plurality of printing means.

8. An ink jet recording apparatus according to claim 1, further comprising print signal input means for inputting signals representing the image to be printed on the recording medium by said plurality of printing means.

9. An information processing apparatus according to claim 8, wherein said print signal input means comprises a keyboard.

10. An ink jet recording apparatus according to claim 1, further comprising:

carriage means for mounting said plurality of printing means; and moving means for moving said carriage means in an area along the recording medium, wherein said recovery means is provided within the area in which said carriage is moved by said moving means and in a position where each of said plurality of printing means can face said recovery means, and wherein said control means controls the moving so that each of said plurality of printing means is moved in turn to face said recovery means, and controls the recovery operation so that ink from the printing means facing said recovery means is recovered in turn.

11. An ink discharge recovery method for an ink jet printing apparatus that includes a plurality of printing means discharging ink corresponding thereto onto a printing medium and recovery means for recovering and maintaining an ink discharge condition of the printing means by exhausting ink from a discharge opening of each of the printing means using a single recovery device, said method comprising the steps of:

aligning each of the plurality of printing means in turn to a position to face the recovery means;

discriminating a property of ink corresponding to the printing means aligned with the recovery means;

reading out an exhausted amount of ink corresponding to the discriminated property of ink from memory means for storing an exhaust amount of ink corresponding to each property of ink;

setting conditions for recovery operation in accordance with data regarding the property of the ink read out in said reading step; and operating the recovery means so that it exhausts an adequate amount of ink from the aligned printing means in accordance with the property of ink corresponding to the aligned printing means.

* * * * *

UNITED STATES PATENT AND TRADEMARK OFFICE

CERTIFICATE OF CORRECTION

PATENT NO. : 5,831,646

DATED : November 3, 1998

INVENTOR(S) : Akira Kuronuma, Takayuki Murata, Hiroshi Fukui, Akira Nagatomo, Shinichi Omo It is certified that error appears in the above-indentified patent and that said Letters Patent is hereby corrected as shown below:

IN THE DRAWINGS

Sheet 3, Figure 3, change "PEOGRAM" to --PROGRAM--.

Sheet 15, Figure 15, change "KEY BOARD" to KEYBOARD--.

COLUMN 2

Line 2, change "form" to --from--.

COLUMN 6

Line 22, change "embodiment" to --an embodiment--.

COLUMN 14

Line 63, change "an" to --the--.

UNITED STATES PATENT AND TRADEMARK OFFICE

CERTIFICATE OF CORRECTION

PATENT NO. : 5,831,646

DATED : November 3, 1998

INVENTOR(S) : Akira Kuronuma, Takayuki Murata, Hiroshi Fukui, Akira Nagatomo, Shinichi Omo It is certified that error appears in the above-indentified patent and that said Letters Patent is hereby corrected as shown below:

COLUMN 15

Line 15, change "the image" to --an image-- and "on the" to --on an--".

Line 17, change "information processing" to --ink jet recording--.

Signed and Sealed this

Twenty-sixth Day of October, 1999

*Attest:*

Q. TODD DICKINSON

*Attesting Officer*

*Acting Commissioner of Patents and Trademarks*